US011976867B2

(12) United States Patent
Ryu et al.

(10) Patent No.: US 11,976,867 B2
(45) Date of Patent: May 7, 2024

(54) ICE MAKER APPLIANCE LEAK DETECTION

(71) Applicant: Haier US Appliance Solutions, Inc., Wilmington, DE (US)

(72) Inventors: Choon Jae Ryu, Prospect, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/748,428

(22) Filed: May 19, 2022

(65) Prior Publication Data

US 2023/0375246 A1 Nov. 23, 2023

(51) Int. Cl.
*F25C 1/25* (2018.01)
*F25C 5/06* (2006.01)

(52) U.S. Cl.
CPC ..... *F25C 1/25* (2018.01); *F25C 5/06* (2013.01); *F25C 2400/10* (2013.01); *F25C 2500/06* (2013.01); *F25C 2700/12* (2013.01)

(58) Field of Classification Search
CPC ..... F25C 1/25; F25C 5/06; F25C 2400/10; F25C 2500/06; F25C 2700/12
See application file for complete search history.

(56) References Cited

U.S. PATENT DOCUMENTS 6,601,399 B2 8/2003 Kuroyanagi et al.
2015/0059394 A1* 3/2015 Gomes ..... F25C 5/06 62/340

FOREIGN PATENT DOCUMENTS

JP 5414755 B2 2/2014
KR 100231151 B1 11/1999
KR 100343677 B1 12/2002

* cited by examiner

*Primary Examiner* — Elizabeth J Martin
*Assistant Examiner* — Samba Gaye
(74) *Attorney, Agent, or Firm* — Dority & Manning, P.A.

(57) ABSTRACT

A method of operating an ice maker appliance includes directing liquid water to a mold body of the ice maker appliance. The method also includes determining that at least a portion of the liquid water escaped based on at least one of an ice making time, a harvest motor torque, or a temperature change rate. The method further includes providing a user notification in response to determining that at least the portion of the liquid water escaped.

9 Claims, 11 Drawing Sheets

ICE MAKER APPLIANCE LEAK DETECTION

FIELD OF THE INVENTION

The present subject matter relates generally to ice maker appliances, and in particular to systems and methods for detecting leaks in such appliances.

BACKGROUND OF THE INVENTION

Certain refrigerator appliances include an ice maker. An ice maker may also be a stand-alone appliance designed for use in commercial and/or residential kitchens. To produce ice, liquid water is directed to the ice maker and frozen. For example, certain ice makers include a mold body for receiving liquid water. After ice is formed in the mold body, it may be harvested from the mold body and stored within an ice bin or bucket within the refrigerator appliance.

In some circumstances, an amount of the liquid water directed to the mold body may escape from the mold body prior to forming into ice as intended. For example, the mold body may develop a crack, one or more sealing elements may wear out, or the mold body may be overfilled. In one example of a possible overfill scenario, a twist tray ice maker may include a partitioned plastic mold that is physically deformed to break the bond formed between ice and the tray, in such ice makers, the ice cubes may be fractured during the twisting process. When such fracturing occurs, a portion of the cubes may remain in the tray, thus resulting in overfilling during the next fill process.

The various circumstances which may lead to liquid water escaping from the mold body are generally not readily observable by a user of the ice maker. As a result, such circumstances may persist for an extended period of time and/or reach a significant quantity of water escaping from the ice maker, such as a sufficient time and/or quantity for secondary effects of the escaped water to manifest, before the user is even aware of the water escaping, let alone able to remediate the issue.

Accordingly, an ice maker with features for improved leak detection would be desirable.

BRIEF DESCRIPTION OF THE INVENTION

Aspects and advantages of the invention will be set forth in part in the following description, or may be apparent from the description, or may be learned through practice of the invention.

According to an exemplary embodiment, a method of operating an ice maker appliance is provided. The ice maker appliance includes a mold body. The method includes directing liquid water to the mold body and calculating an ice making time after directing the liquid water to the mold body. The method also includes determining that the calculated ice making time is less than an allowed ice making time. Because the calculated ice making time is less than an allowed ice making time, it may be determined that at least a portion of the liquid water escaped. The method further includes providing a user notification in response to determining that at least the portion of the liquid water escaped.

According to another exemplary embodiment, a method of operating an ice maker appliance is provided. The ice maker appliance includes a mold body and a harvest motor. The method includes directing liquid water to the mold body and determining that ice has formed in the mold body after directing the liquid water to the mold body. The method also includes harvesting the ice from the mold body. Harvesting the ice from the mold body includes activating the harvest motor. The method further includes measuring, during harvesting the ice from the mold body, a torque of the harvest motor and determining that the measured torque of the harvest motor is less than a minimum harvest torque threshold. Because the measured torque of the harvest motor is less than the minimum harvest torque threshold, it may be determined that at least a portion of the liquid water escaped. The method further includes providing a user notification in response to determining that at least the portion of the liquid water escaped.

According to another exemplary embodiment, a method of operating an ice maker appliance is provided. The ice maker appliance includes a mold body and a temperature sensor operable to measure a temperature at the mold body. The method includes directing liquid water to the mold body and calculating a temperature change rate of a temperature of the mold body after directing the liquid water to the mold body. The method also includes determining that the calculated temperature change rate is greater than a maximum temperature change rate threshold. Because the calculated temperature change rate is greater than the maximum temperature change rate threshold, it may be determined that at least a portion of the liquid water escaped. The method further includes providing a user notification in response to determining that at least the portion of the liquid water escaped.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
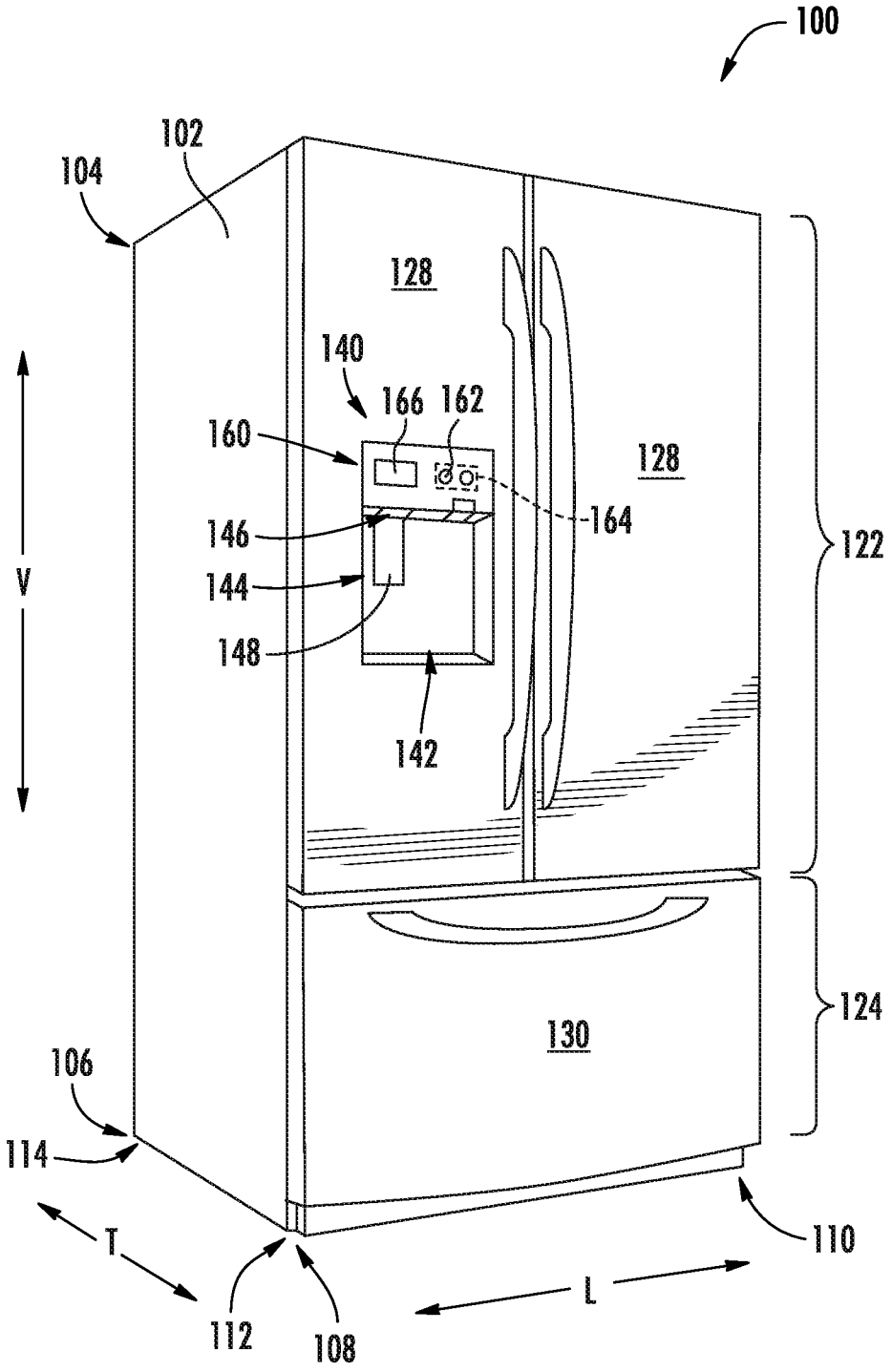
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise. As used herein, the terms "first," "second," and "third" may be used interchangeably to distinguish one component from another and are not intended to signify location or importance of the individual components.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
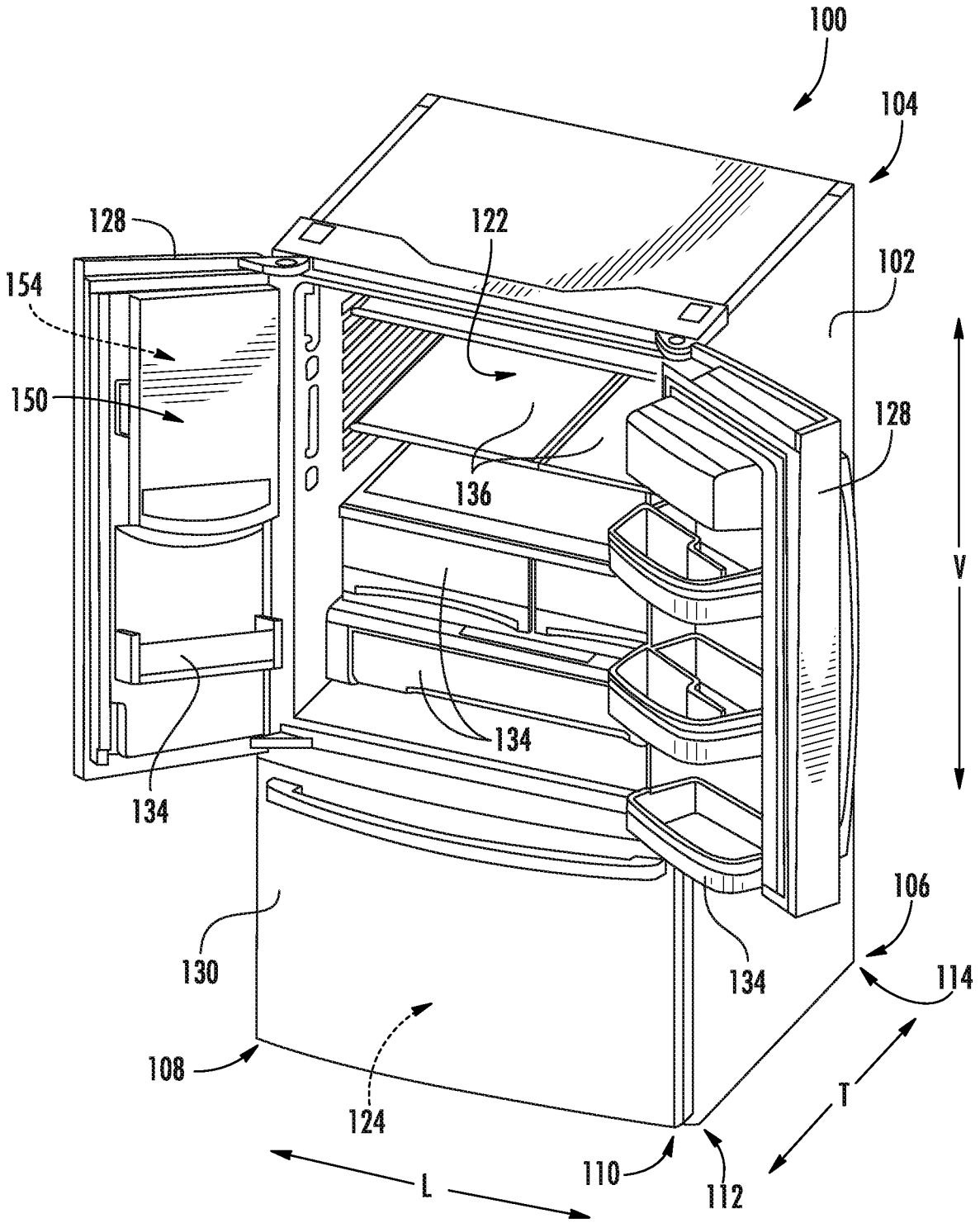
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items, etc.) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

By contrast, inside refrigerator appliance 100, refrigerator door 128 may define an icebox 150 (FIGS. 2 through 4) housing an ice maker 200 and an ice storage bin 202 that are configured to supply ice to dispenser recess 142. In this regard, for example, icebox 150 may define an ice making chamber 154 for housing an ice making assembly, a storage mechanism, and a dispensing mechanism.

A control panel 160 is provided for controlling the mode of operation. For example, control panel 160 includes one or more selector inputs 162, such as knobs, buttons, touchscreen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations.

Figure 3:
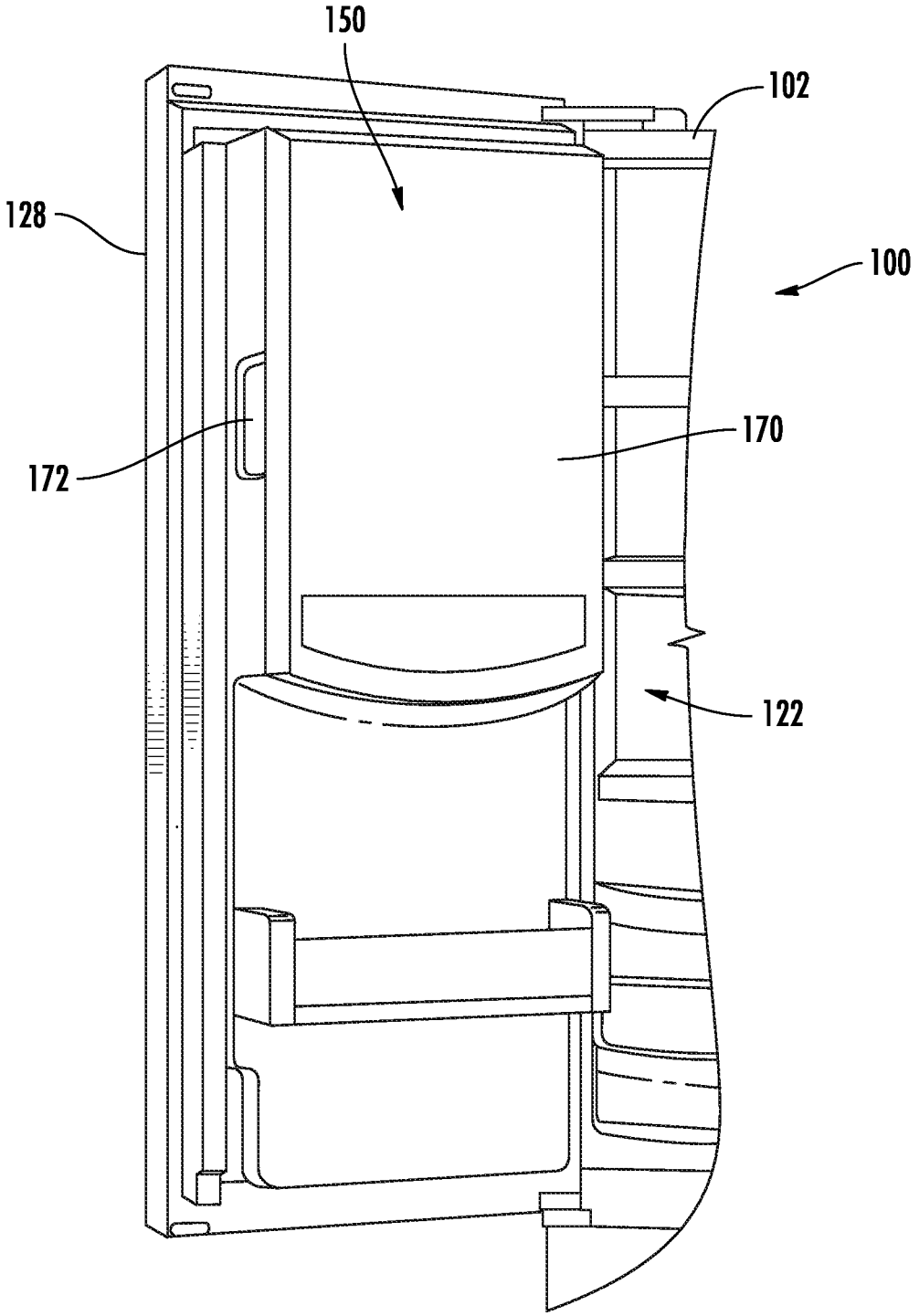
FIG. 3 provides an interior perspective view of a dispenser door of the exemplary refrigerator appliance of FIG. 1.
Figure 4:
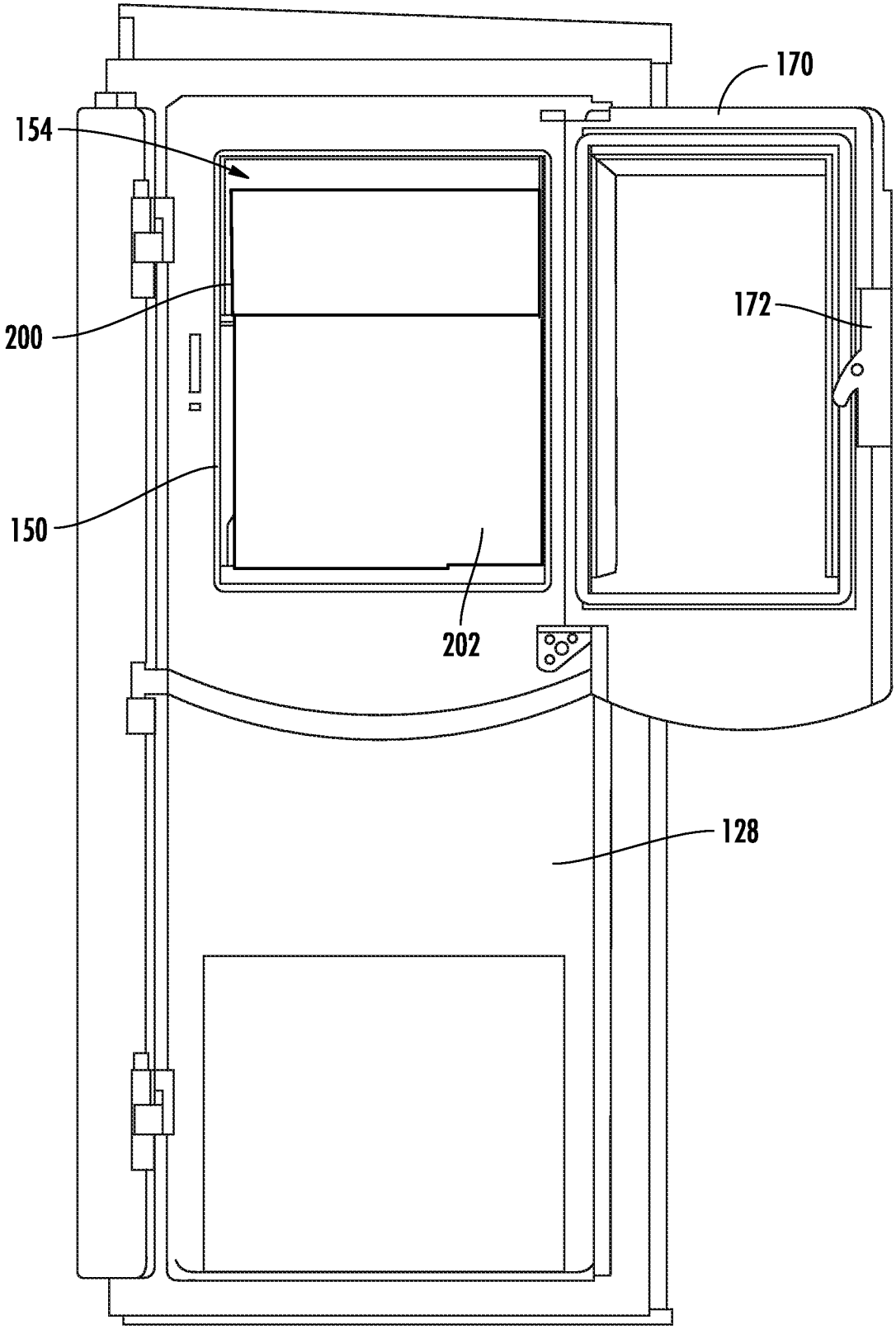
FIG. 4 provides an interior elevation view of the door of FIG. 3 with an access door of the door shown in an open position.

Referring now to FIGS. 3 and 4, FIG. 3 provides an interior perspective view of one of the refrigerator doors 128 and FIG. 4 provides an interior elevation view of the door 128 with an access door 170 shown in an open position. Refrigerator appliance 100 includes a sub-compartment 150 defined on refrigerator door 128. As mentioned above, the sub-compartment 150 may be referred to as an "icebox." In the illustrated exemplary embodiment, icebox 150 extends into fresh food chamber 122 when refrigerator door 128 is in the closed position. As shown in FIG. 4, an ice maker 200 may be positioned within the ice box 150. The ice maker 200 is generally configured for freezing the water to form ice, e.g., ice pieces such as ice cubes, which may be stored in storage bin 202 and dispensed through discharging outlet 146 by dispensing assembly 140. FIG. 4 illustrates the ice maker 200 with an ice storage bin 202 positioned below the ice maker 200 for receiving ice pieces from the ice maker 200, e.g., for receiving the ice after the ice is ejected from the ice maker 200. As those of ordinary skill in the art will recognize, ice from the ice maker 200 is collected and stored in the ice storage bin 202 and supplied to dispenser 144 (FIG. 1) from the ice storage bin 202 in icebox 150 on a back side of refrigerator door 128. Chilled air from a sealed system (not shown) of refrigerator appliance 100 may be directed into components within the icebox 150, e.g., ice maker 200 and/or ice storage bin 202.

As mentioned above, the present disclosure may also be applied to other types and styles of refrigerator appliances such as, e.g., a top mount refrigerator appliance, a side-by-side style refrigerator appliance or a standalone ice maker appliance. Variations and modifications may be made to ice maker 200 while remaining within the scope of the present subject matter. Accordingly, the description herein of the icebox 150 on the door 128 of the fresh food chamber 122 is by way of example only. In other example embodiments, the ice maker 200 may be positioned in the freezer chamber 124, e.g., of the illustrated bottom-mount refrigerator, of a side by side refrigerator, of a top-mount refrigerator, or any other suitable refrigerator appliance. As another example, the ice maker 200 may also be provided in a standalone ice maker appliance. As used herein, the term "standalone ice maker appliance" refers to an appliance of which the sole or primary operation is generating or producing ice, whereas the more general term "ice maker appliance" includes such appliances as well as appliances with diverse capabilities in addition to making ice, such as a refrigerator appliance equipped with an ice maker, among other possible examples.

As mentioned above, an access door 170 may be hinged to the inside of the refrigerator door 128. Access door 170 permits selective access to icebox 150. Any manner of suitable latch 172 may be configured with icebox 150 to maintain access door 170 in a closed position. As an example, latch 172 may be actuated by a consumer in order to open access door 170 for providing access into icebox 150. Access door 170 can also assist with insulating icebox 150, e.g., by thermally isolating or insulating icebox 150 from fresh food chamber 122.

Figure 5:
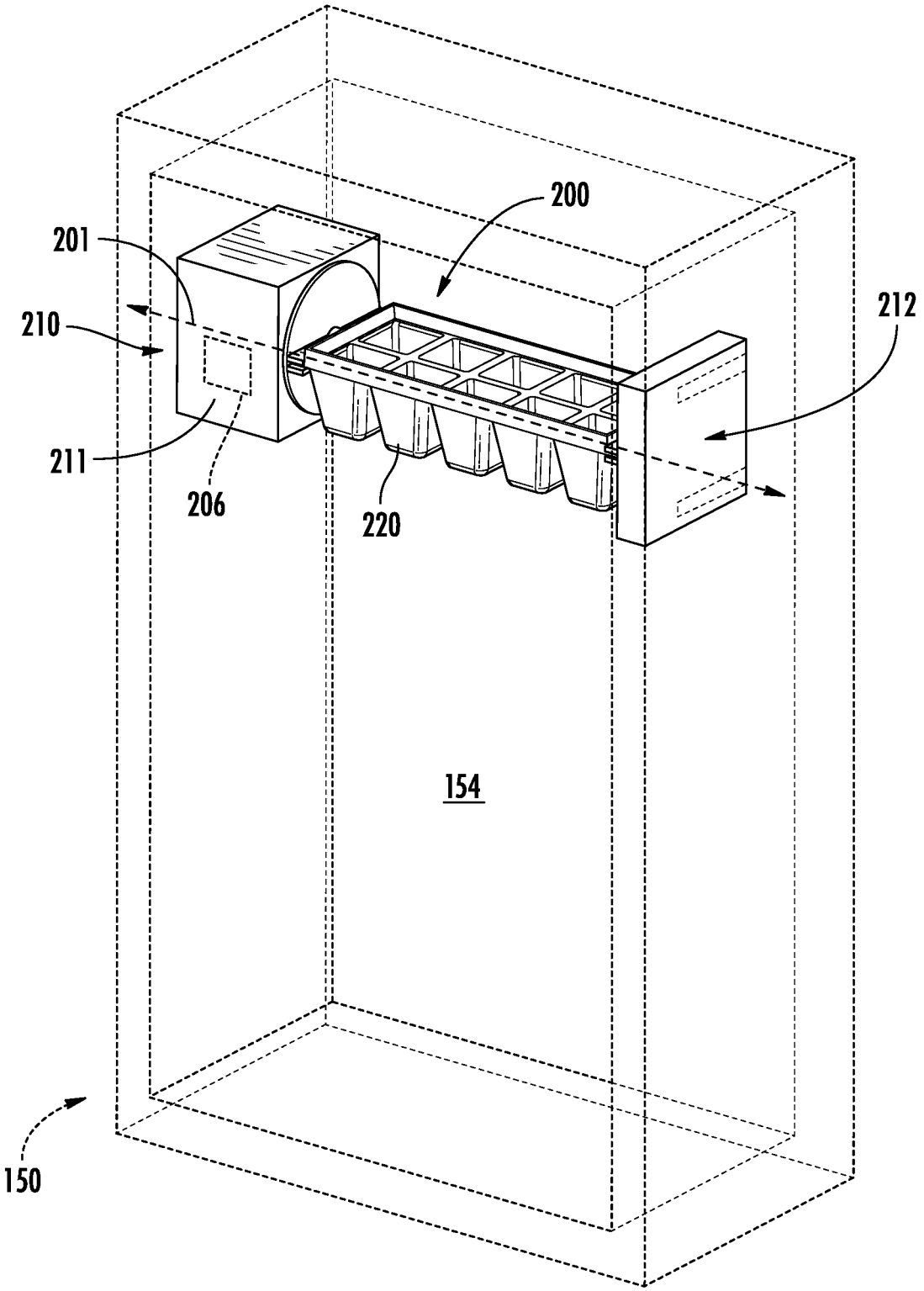
FIG. 5 provides a perspective view of an exemplary ice maker disposed in an icebox in accordance with one or more embodiments of the present disclosure.
Figure 6:
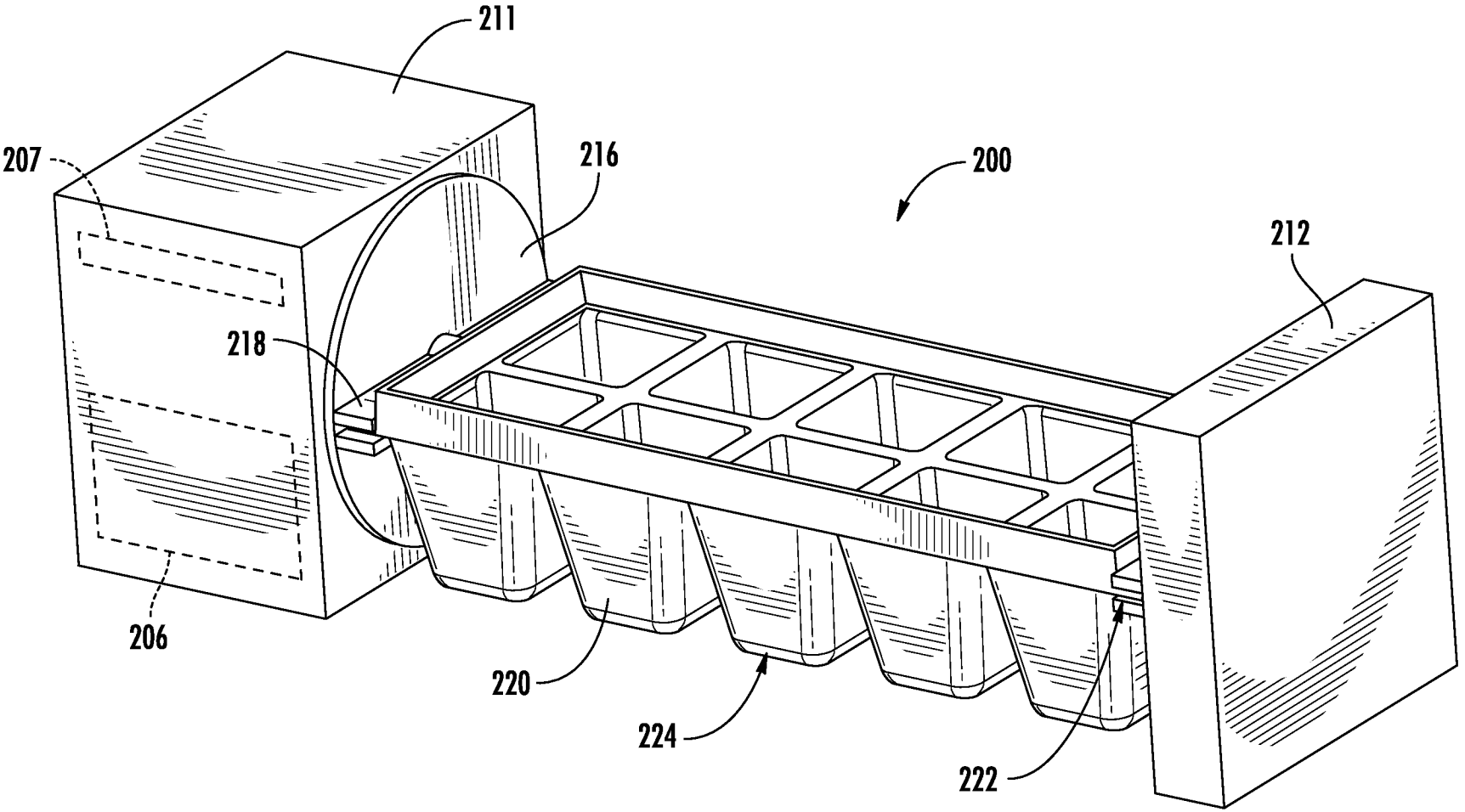
FIG. 6 provides another perspective view of the exemplary ice maker of FIG. 5.

Referring now to FIGS. 5 and 6, perspective views of one exemplary embodiment of the ice maker 200 are illustrated. In some embodiments, e.g., as illustrated in FIGS. 5 and 6, the ice maker 200 may be a twist tray ice maker. In such embodiments, the ice maker 200 may include a mount unit 210 positioned in the icebox 150, e.g., mounted on one or more internal surfaces of the icebox 150. The mount unit 210 may be coupled to an ice tray 220, e.g., the mount unit 210 may be configured to releasably receive the ice tray 220. The ice tray 220 may provide a mold body of the ice maker 200, e.g., the ice tray 220 may include one or more compartments 224 for receiving liquid water therein, and the liquid water may be retained within the compartment(s) 224 until ice is formed (or at least a portion of the liquid water may be retained). The ice tray 220 may comprise a flexible, e.g., twistable, material, such as the ice tray 220 may comprise a plastic material which is sufficiently flexible to twist the ice tray 220 in order to promote disengagement, e.g., release, of ice pieces in the ice tray 220, as is understood by those of ordinary skill in the art.

In some embodiments, the mount unit 210 may include a first mount unit 211 and a second mount unit 212. The mount units 211, 212 may be spaced apart from one another along a central axis 201 of the ice maker 200. In various embodiments, a direction of the central axis 201 corresponds to, e.g., is along or parallel to, a longitudinal axis of the ice tray 220 when the ice tray 220 is installed to the mount unit 210. Furthermore, the mount units 211, 212 may be spaced apart from one another such as to allow a pair of lips 222 (FIG. 6) of the ice tray 220 separated along the central axis 201 to be received by respective mount units 211, 212. For example, the mount unit 210 may include one or more clips 218, e.g., a first clip 218 on the first mount unit 211 and a second clip 218 on the second mount unit 212, and the lip(s) 222 of the ice tray 220 may be configured to be received within and retained by the clip(s) 218, e.g., the lip(s) 222 may each be sized and shaped corresponding to a respective clip 218, such as the external dimensions of the lip 222 or each lip 222 may correspond to internal dimensions of the clip 218 or each clip 218, whereby the lip(s) 222 may be received within and retained by the clip(s) 218.

In various embodiments, the mount unit 210 includes a rotor 216 configured to rotate relative to a central axis 201. In such embodiments, the first clip 218 on the first mount unit 211 may be formed integrally with the rotor 216. The first mount unit 211 may be fixed to the icebox 150. The first mount unit 211 may include a motor or other actuation device 206 operably coupled to the rotor 216 to rotate relative to the central axis 201, e.g., about the central axis 201. When the ice tray 220 is installed onto the rotor 216, rotation of the rotor 216, such as by the actuation device 206, causes the ice tray 220 to dump or deposit ice or other contents from the ice tray 220.

In some embodiments, the ice maker 200 may include a dedicated controller 207, e.g., similar to the controller 164 of the refrigerator appliance 100 which is described above. In embodiments where the ice maker 200 is incorporated into a refrigerator appliance such as the exemplary refrigerator appliance 100 described hereinabove, the dedicated controller 207 may be in addition to the controller 164 of the refrigerator appliance and may be in communication with the controller 164 of the refrigerator appliance 100, and the controller 207 of the ice maker 200 may be in operative communication with other components of the ice maker 200 and may be configured specifically for controlling or directing operation of such components, e.g., the actuation device 206. In some embodiments, the ice maker 200 may also include one or more sensors, such as a temperature sensor as will be described further hereinbelow, and the dedicated controller 207 of the ice maker 200 may also be in operative communication with such sensors.

For example, the controller 207 may cause the actuation device 206 to rotate a first amount, e.g., through a first number of degrees about the central axis 201, to twist the tray 220 and thereby promote release of ice pieces from the compartment 224 thereof, such as rotating the first amount in a first direction followed by rotating the same amount, e.g., the first amount, in a second direction opposite the first direction to twist the tray 220 to release ice pieces from the compartments 224. After rotating the first amount, e.g., after twisting the tray 220, the controller 207 may then cause the actuation device 206 to rotate a second amount, e.g., through a second number of degrees about the central axis 201, greater than the first amount to tip over or invert the tray 220, allowing the ice pieces to fall, e.g., by gravity, from the tray 220 into the bin 202 (FIG. 4) below the ice maker 200.

Figure 7:
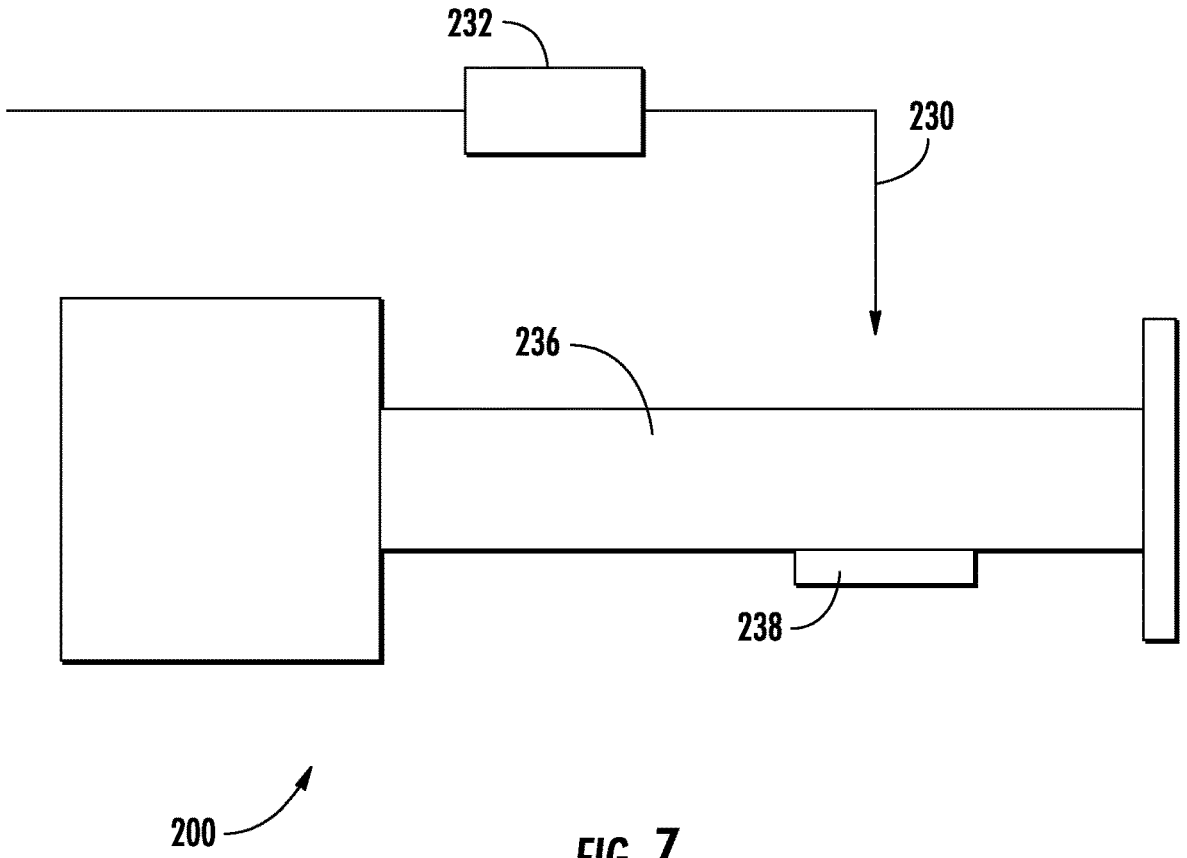
FIG. 7 provides a schematic illustration of components of an ice maker appliance in accordance with one or more embodiments of the present disclosure.
Figure 8:
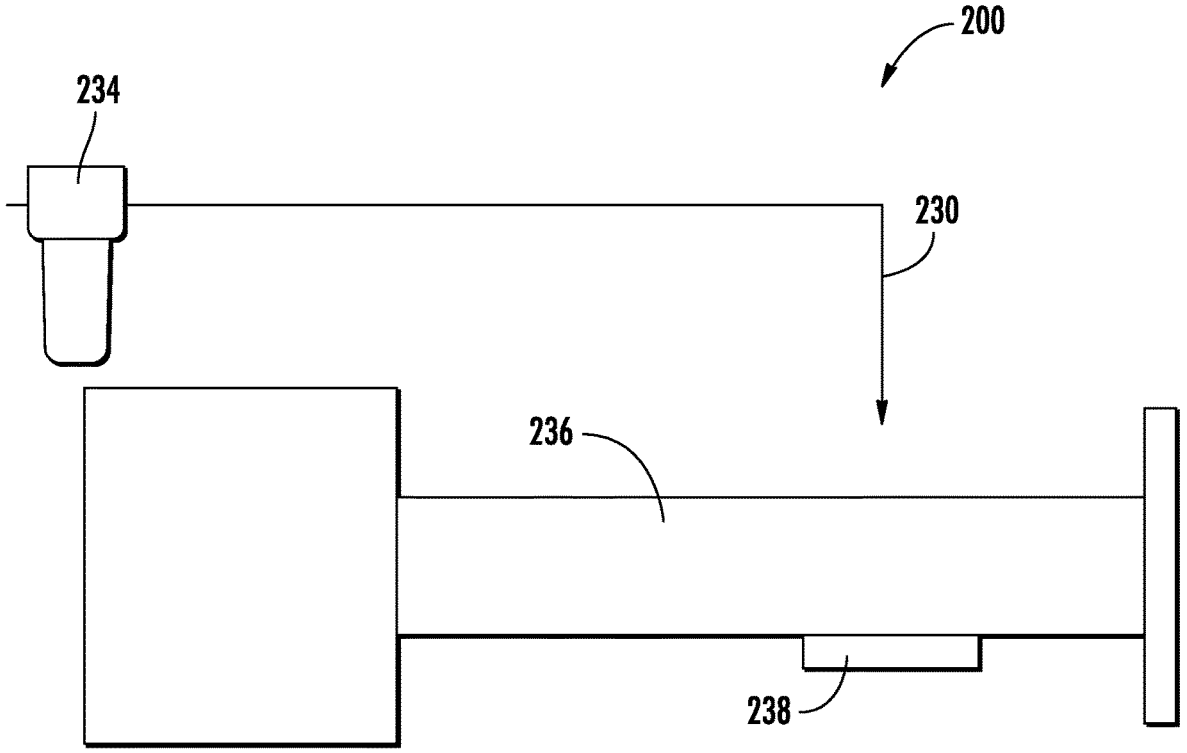
FIG. 8 provides a schematic illustration of components of an ice maker appliance in accordance with one or more additional embodiments of the present disclosure.

FIGS. 7 and 8 provide schematic illustrations of various embodiments of an ice maker 200 according to the present disclosure. As may be seen in FIGS. 7 and 8, ice maker 200 may include or be provided with a water line 230 which is positioned and configured to direct a flow of liquid water to a mold body 236 of the ice maker 200, e.g., the flow of liquid water may be directed towards and/or into the mold body 236. For example, the mold body 236 may be the tray 220 described above with respect to FIGS. 5 and 6, or any other suitable mold body 236 for receiving and retaining liquid water in order to form ice pieces, such as ice cubes, ice gems, etc., therein. The ice maker 200 may also include a temperature sensor 238. Temperature sensor 238 is configured for measuring a temperature of mold body 236 and/or objects, such as liquid water and/or solid water, within mold body 236. Temperature sensor 238 can be any suitable device for measuring the temperature of mold body 236 and/or objects therein. For example, temperature sensor 238 may be a thermistor or a thermocouple or a bimetal. Controller 207 (FIG. 6) can receive a signal, such as a voltage or a current, from temperature sensor 238 that corresponds to the temperature of the mold body 236 and/or objects therein. In such a manner, the temperature of mold body 236 and/or objects therein can be monitored and/or recorded with controller 207. Some embodiments can also include an electromechanical ice maker configured with a bimetal to complete an electrical circuit when a specific temperature is reached.

Referring now specifically to FIG. 7, in some embodiments, a flow meter 232 may be provided in the water line 230. Thus, a quantity, e.g., volume, of liquid water provided to the mold body 236 may be directly measured, e.g., by or using the flow meter 232. For example, the flow meter 232 may be in operative communication with the controller 207 and/or may be communicatively coupled with the controller 207 in order to transmit signals, in a similar manner as described above with respect to the temperature sensor 238, indicative of or corresponding to the flow of liquid water through the water line 230 and to the mold body 236 as measured by the flow meter 232.

Referring now to FIG. 8 in particular, in some embodiments, a water filter 234 may be provided in, e.g., coupled to and/or in-line with, the water line 230. Thus, liquid water which flows through the water line 230 and to the mold body 236 may also flow through the filter 234, e.g., upstream of the mold body 236 whereby the liquid water flows through the filter 234 before being delivered to the mold body 236. In such embodiments, the ice maker 200, e.g., the controller 207 thereof, may be operable and configured to monitor or query a status of the water filter 234, such as an age of the water filter 234. For example, the water filter 234 may be removably coupled to the water line 230, whereby the water filter 234 may be removed and replaced periodically, such as after a predetermined period of months following the initial installation of the water filter. For example, the water filter 234 may have a service life of about six months.

Figure 9:
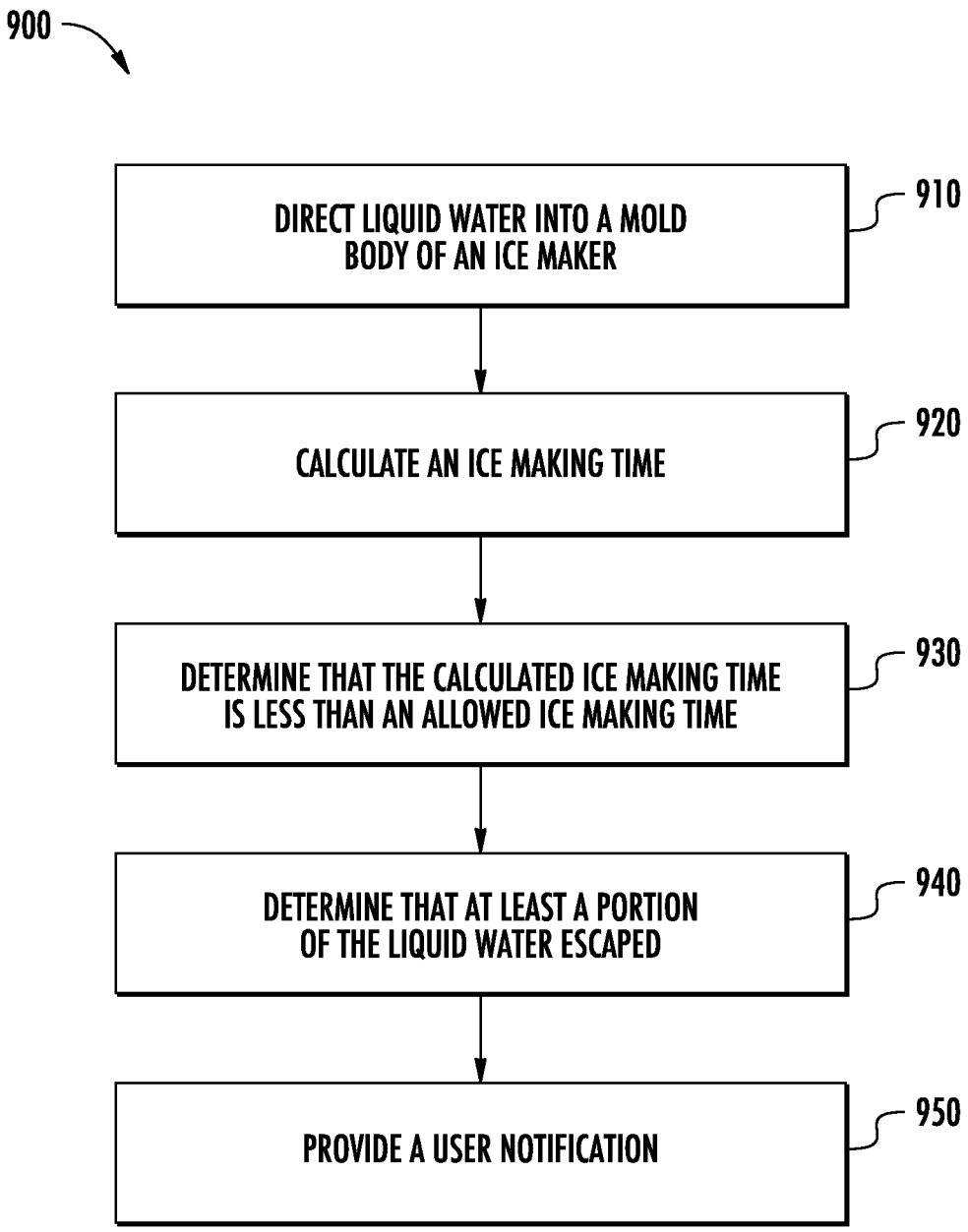
FIG. 9 provides a flow chart illustrating an exemplary method of operating an ice maker appliance in accordance with one or more embodiments of the present subject matter.
Figure 10:
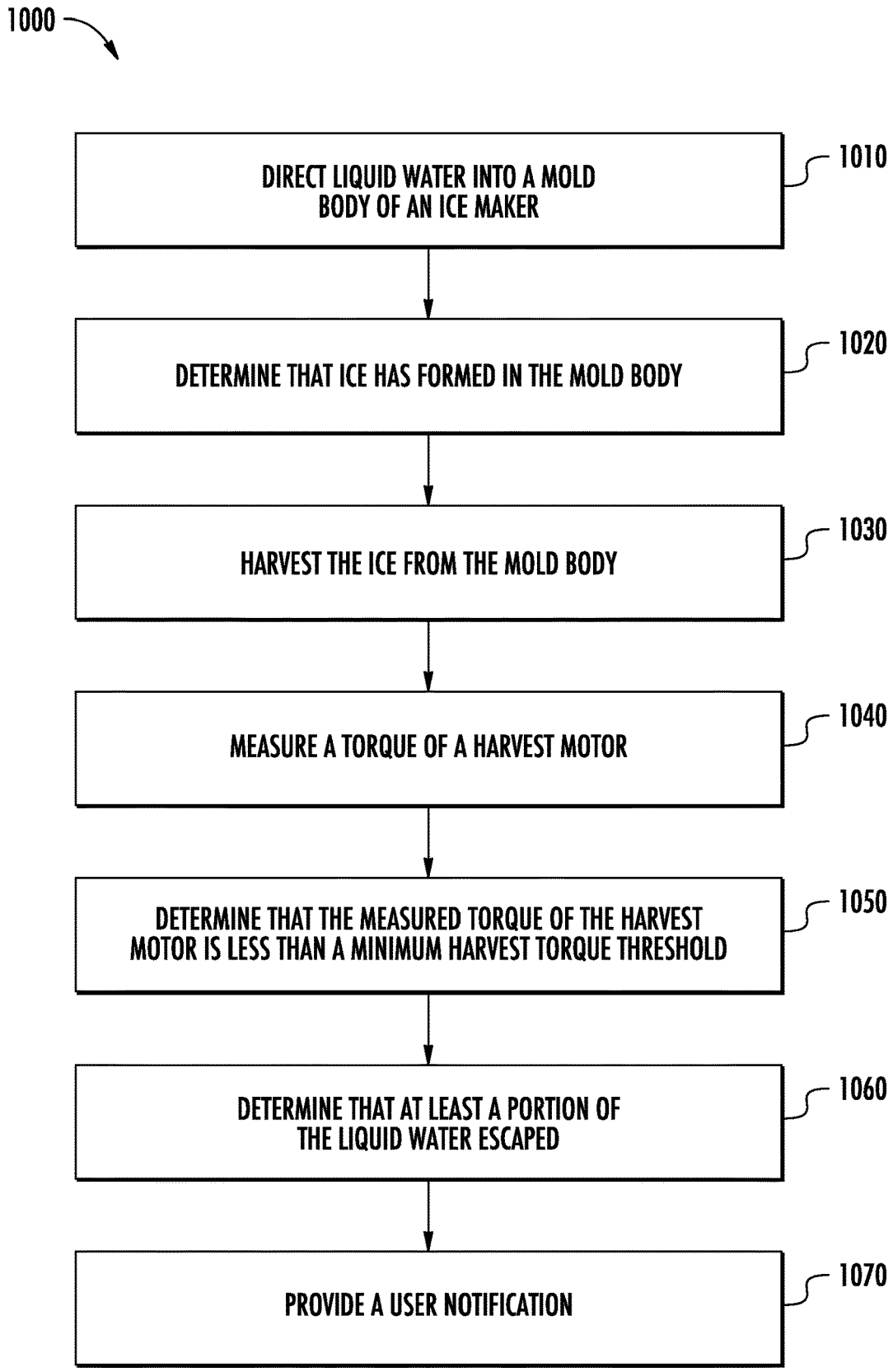
FIG. 10 provides a flow chart illustrating another exemplary method of operating an ice maker appliance in accordance with one or more additional embodiments of the present subject matter.
Figure 11:
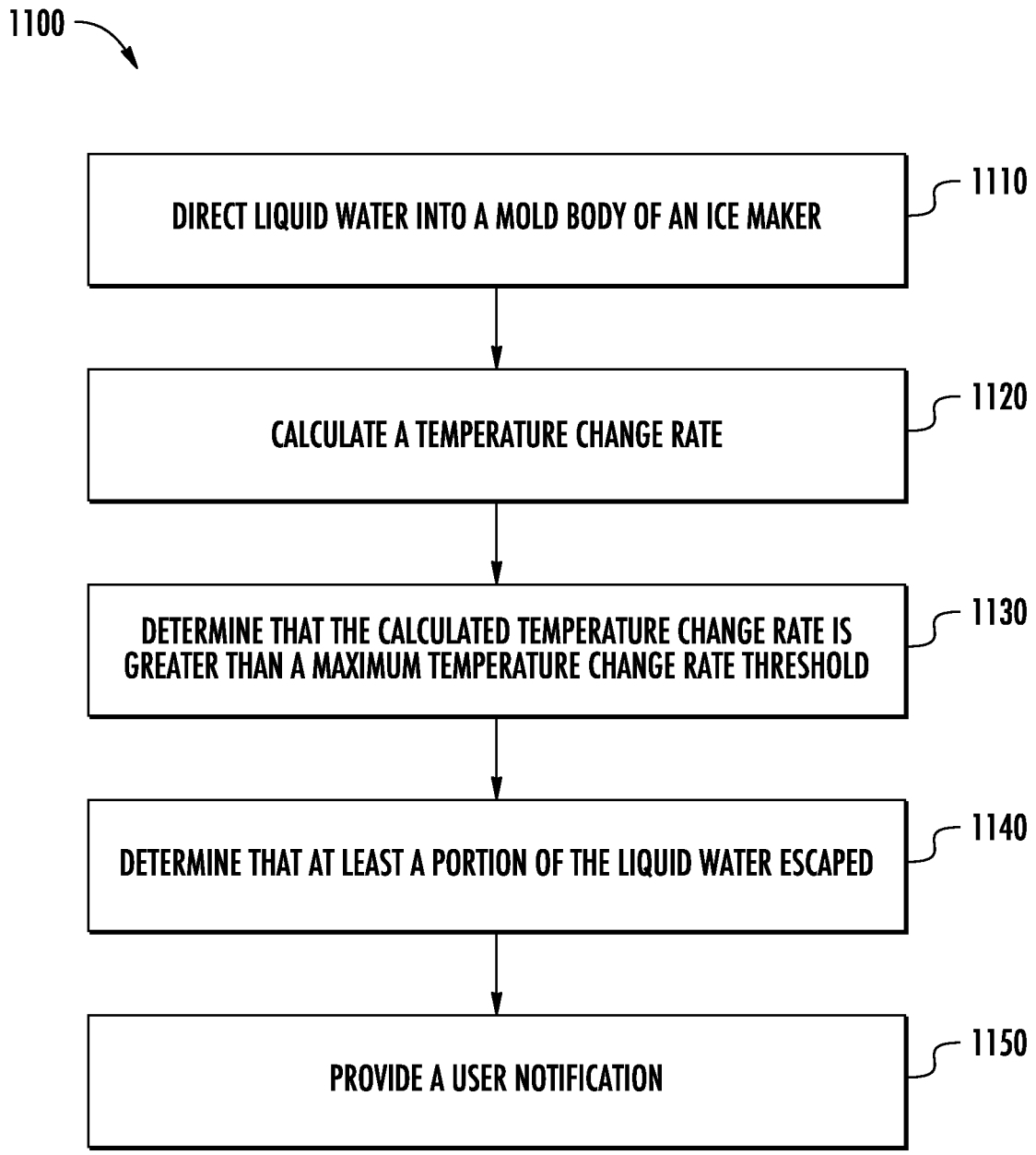
FIG. 11 provides a flow chart illustrating still another exemplary method of operating an ice maker appliance in accordance with one or more additional embodiments of the present subject matter.

Turning now to FIGS. 9 through 11, embodiments of the present disclosure may include methods of operating an ice maker appliance, such as the exemplary ice maker appliance 200 described above.

As shown in FIG. 9, method 900 may include directing liquid water to the mold body, e.g., as indicated at 910 in FIG. 9. After directing the liquid water to the mold body, the method 900 may include a step 920 of calculating an ice making time, e.g., the amount of time that it takes for the liquid water (or at least as much of it as actually is received and retained in the mold body) to turn into ice within the mold body. For example, the ice making time may be calculated by monitoring a temperature at the mold body, e.g., by directly measuring the mold body temperature with a temperature sensor in direct contact with the mold body or by measuring an ambient temperature in an area immediately surrounding the mold body, from which a temperature of the mold body may be inferred, and tracking a time until the monitored temperature reaches a level at which the formation of ice is indicated, such as about thirty two degrees Fahrenheit or less, where such level may also be an ice formation threshold. The ice making time may also be calculated based on how long the monitored temperature remains at or below the level at which the formation of ice is indicated, such as when the monitored temperature remains at or below the level for at least a minimum time and/or based on a time-temperature integration, as will be described further below.

In some embodiments, given a known volume of ice to be produced, such as based on the volume of the mold body, e.g., the volume of the compartments 224 in embodiments where the mold body is provided as the ice tray 220, an expected or allowed ice making time may be determined. The expected or allowed ice making time may also be based on the volume of liquid water provided to the mold body, e.g., the volume of liquid water referred to at 910 in FIG. 9, where the volume of liquid water may be determined or measured in various ways as will be described below. For example, the allowed ice making time may be a minimum time, e.g., the shortest amount of time in which the known volume of liquid water may freeze, e.g., given the expected starting temperature of the liquid water directed to the mold body and the operating temperature of a cooling system of the ice maker appliance. Thus, in some embodiments, method 900 may also include determining that the calculated ice making time from step 920 is less than an allowed ice making time, e.g., as indicated at 930 in FIG. 9. When the actual ice making time, e.g., the calculated ice making time, is shorter than expected, e.g., is less than the allowed ice making time, it may be inferred that the volume of liquid water that was frozen during the calculated ice making time is less than the intended volume of water, e.g., is less than the volume of water that was directed to the mold body at step 910. Accordingly, when less than all of the water that was directed to the mold body ultimately turns into ice, the amount of the water which did not freeze may have escaped from the mod body. Liquid water may escape from the mold body in one or more of various ways, such as may not have reached the mold body at all, e.g., due to a misalignment of a fill line and the mold body or a deformation of or obstruction in the fill line which causes erratic flow from the fill line (such as some of the liquid water may have sprayed from the fill line outside of the mold body, e.g., some of the liquid water may have been directed to the mold body but then diverged from such path before reaching the mold body). As another example, liquid water may escape from the mold body by overflowing, such as when the mold body is partially obstructed, e.g., by remnants of previously-formed ice therein, or by leaking, e.g., from a crack in the mold body.

As another example, in some embodiments, the method 900 may also include transmitting a user notification, e.g., to a display on the ice maker appliance and/or to a remote user interface device, after detecting escaped water, e.g., as illustrated at step 950 in FIG. 9. For example, in embodiments where the ice maker appliance is a refrigerator appliance having an ice maker therein, such as refrigerator appliance 100, the controller 207 of the ice maker 200 may communicate with the controller 164 of the refrigerator appliance 100 whereby the user notification may be displayed on a user interface of the refrigerator appliance 100, such as on display 166 (FIG. 1). In exemplary embodiments where the user notification is also or instead provided on the remote user interface device, the remote user interface device may be any suitable device such as a laptop computer, smartphone, tablet, personal computer, wearable device, smart speaker, smart home system, and/or various other suitable devices. The remote user interface device is "remote" at least in that it is spaced apart from and not physically connected to the ice maker appliance, e.g., the remote user interface device is a separate, stand-alone device from the ice maker appliance which communicates with the ice maker appliance wirelessly, e.g., through various possible communication connections and interfaces such as WI-FI®. The ice maker appliance and the remote user interface device may be matched in wireless communication, e.g., connected to the same wireless network. The ice maker appliance may communicate with the remote user interface device via short-range radio such as BLUETOOTH® or any other suitable wireless network having a layer protocol architecture. Any suitable device separate from the ice maker appliance that is configured to provide and/or receive communications, information, data, or commands from a user may serve as the remote user interface device, such as a smartphone, smart watch, personal computer, smart home system, or other similar device. For example, the remote user interface device may be a smartphone operable to store and run applications, also known as "apps," and some or all of the method steps disclosed herein may be performed by a smartphone app. For example, the user notification may be or include an email, a text message, and/or other suitable notifications via a remote user interface device.

As mentioned above, the allowed ice making time may be proportional to or based on a volume of liquid water directed to the mold body. For example, in some embodiments the ice maker appliance may include a flow meter, e.g., as described above with respect to FIG. 7. In such embodiments, the method may further include measuring a flow rate of the liquid water while directing the liquid water to the mold body and determining a volume of the liquid water from the measured flow rate, wherein the allowed ice making time is based on the determined volume of the liquid water. In additional embodiments, the ice maker appliance may also or instead include a water filter, e.g., as described above with respect to FIG. 8. In such embodiments, the method may further include determining a status of the water filter, wherein the allowed ice making time is based on the determined status of the water filter. For example, the status of the water filter may include an age of the water filter, and a flow rate of the liquid water directed to the mold body may be determined based on the age of the filter, e.g., where older filters are more clogged and thus provide a reduced flow of water therethrough to the mold body. In some embodiments, the method may include determining a flow rate of the liquid water based on the status of the water filter and determining a volume of the liquid water from the determined flow rate, such as determining the volume of liquid water directed to the mold body based on the determined flow rate multiplied by a flow time.

Another exemplary method of operating an ice maker appliance according to one or more embodiments of the present disclosure is illustrated in FIG. 10. The ice making appliance may include a mold body and a harvest motor, e.g., tray 220 may be an embodiment of the mold body and actuation device 206 may be an embodiment of the harvest motor. As shown in FIG. 10, the exemplary method 1000 may include a step 1010 of directing liquid water to the mold body, e.g., as described above with respect to step 910 of method 900.

Method 1000 may further include determining that ice has formed in the mold body after directing the liquid water to the mold body, e.g., as indicated at 1020 in FIG. 10. For example, the determination that ice has formed may be based on time and/or temperature after flowing the liquid water to the mold body. In some embodiments, the ice maker appliance may include a temperature sensor. In such embodiments, the method may further include monitoring a temperature at the mold body with the temperature sensor, wherein determining that ice has formed in the mold body may be based on the monitored temperature reaching an ice formation threshold, and/or may be based on the monitored temperature remaining at or below the ice formation threshold, and/or may be based on a time-temperature integration, as will be described further below.

Once the ice formation has been detected or determined, the method 1000 may then include a step 1030 of harvesting ice from the mold body. For example, harvesting ice from the mold body may include activating the harvest motor of the ice maker appliance.

Method 1000 may further include a step 1040 of measuring a torque of the harvest motor, e.g., during harvesting the ice from the mold body. The torque provided may be generally proportional to the volume of ice formed, e.g., the extent to which the volume of liquid water that was directed to the mold body actually reached the mold body and remained therein throughout the freezing process. Thus, when the torque during harvesting is less than expected, this may indicate that less ice was formed than expected, e.g., that less than all of the volume of liquid water directed to the mold body ultimately became ice. For example, method 1000 may further include determining that the measured torque of the harvest motor is less than a minimum harvest torque threshold (1050) and determining, based on the measured torque of the harvest motor less than the minimum harvest torque threshold, that at least a portion of the liquid water escaped (1060).

For example, in embodiments where the mold body includes an ice tray, e.g., a twist tray as described above with reference to FIGS. 5 and 6, harvesting the ice from the mold body may include twisting the ice tray, and the measured torque of the harvest motor may include a torque while twisting the ice tray. For example, the ice tray may twist more easily when there is less ice to break free from the ice tray. Also by way of example, the ice tray may twist more easily (e.g., less torque applied by the harvest motor to twist the ice tray) when the ice tray is cracked, and such cracks in the ice tray may also permit liquid water to escape from the mold body (e.g., from the ice tray which may be the mold body in such embodiments).

Thus, for example, a leak, or other water escape event such as an overfill, misalignment of a fill line, etc., as discussed above, may be detected based on the harvest motor torque. Further, method 1000 may also include providing a user notification in response to determining that at least the portion of the liquid water escaped, e.g., as indicated at (1070) in FIG. 10. As discussed above with respect to method 900, the user notification may be provided on an interface, e.g., display, of the ice maker appliance itself and/or on a remote user interface device.

In various embodiments, the determination that ice has formed in the mold body may be based on a volume of water that was flowed during the step of directing the volume of liquid water to the mold body. Thus, given a certain temperature and/or a certain amount of time after the liquid water was directed to the mold body, it may be determined that the volume of liquid water has frozen.

In some embodiments, the ice maker appliance may include a flow meter. In such embodiments, the method may further include measuring, with the flow meter, a flow rate of the liquid water while directing the liquid water to the mold body and determining a volume of the liquid water from the measured flow rate. Also in such embodiments, determining that ice has formed in the mold body may be based on the determined volume of the liquid water.

In some embodiments, the ice maker appliance may include a water filter. in such embodiments, the method may further include determining a status of the water filter, e.g., an age or maintenance status of the water filter. As discussed above, such status of the water filter may also indicate a flow rate of water therethrough. Thus, in such embodiments, determining that ice has formed in the mold body may be based on the status of the water filter. For example, such embodiments may include determining a flow rate of the liquid water based on the status of the water filter, e.g., the age of the water filter, and determining a volume of the liquid water from the determined flow rate. In such embodiments, determining that ice has formed in the mold body may be based on the determined volume of the liquid water.

In some embodiments, the ice maker appliance may include a temperature sensor. In such embodiments, the method may further include monitoring a temperature at the mold body with the temperature sensor, and determining that ice has formed in the mold body may be based on the monitored temperature, such as the monitored temperature reaching an ice formation threshold. In some embodiments, determining that ice has formed in the mold body may be based on temperature, e.g., the monitored temperature, and on time, such as based on temperature over time. For example, determining that ice has formed may be based on the monitored temperature being at or below the ice formation threshold for at least a minimum ice formation time. As another example, determining that ice has formed may be based on a time-temperature integration, e.g., the area under a curve of temperature over time. In embodiments where the determination that ice has formed is based on the integral of temperature over time, the integral may be taken beginning at a certain point in time and continuing until the integral reaches a threshold value, e.g., the ice formation threshold, where the ice formation threshold may be a time-temperature integration value in such embodiments. For example, the certain point in time at which the integration begins may be when the monitored temperature reaches a limit temperature, such as about thirty two degrees Fahrenheit (32° F.).

Referring now to FIG. 11, an additional exemplary method 1100 is illustrated therein. As shown, the example method 1100 may include directing liquid water to the mold body, e.g., as indicated at 1110 in FIG. 11. Method 1100 may also include a step 1120 of calculating a temperature change rate of a temperature of the mold body after directing the liquid water to the mold body, e.g., as measured by a temperature sensor.

When the temperature decreases too fast, the thermal mass present in the mold body may be less than expected, e.g., the amount of liquid water that was directed to the mold body and then actually was received in and remained in the mold body may be less than the total amount of liquid water directed to the mold body. Thus, for example, exemplary methods according to the present disclosure may include determining that the calculated temperature change rate is greater than a maximum temperature change rate threshold, e.g., as indicated at 1130 in FIG. 11. When the temperature change rate is greater than the maximum temperature change rate threshold, such may indicate that at least a portion of the liquid water escaped, e.g., never reached the mold body and/or escaped from the mold body. Accordingly, some embodiments may include a step 1140 of determining, based on the calculated temperature change rate greater than the maximum temperature change rate threshold, that at least a portion of the liquid water escaped.

Also as illustrated in FIG. 11, method 1100 may further include a step 1150 of providing a user notification in response to determining that at least the portion of the liquid water escaped. The user notification may, as discussed above regarding method 900, be provided on a user interface of the ice maker appliance and/or may be transmitted to a remote user interface device from the ice maker appliance.

In some embodiments, the ice maker appliance may include a flow meter. In such embodiments, the method may further include measuring a flow rate of the liquid water while directing the liquid water to the mold body and determining a volume of the liquid water from the measured flow rate. For example, the maximum temperature change rate threshold may be based on the determined volume of the liquid water.

In some embodiments, the ice maker appliance may include a water filter. In such embodiments, the method may further include determining a status of the water filter, such as an age of the water filter. Also in such example embodiments, the maximum temperature change rate threshold may be based on the determined status of the water filter. For example, the method may further include determining a flow rate of the liquid water based on the status of the water filter and determining a volume of the liquid water from the determined flow rate, and the maximum temperature change rate threshold may be based on the determined volume of the liquid water.

In some embodiments, the maximum temperature change rate threshold may be based on a stored temperature change rate from a previous operating cycle of the ice maker appliance. For example, the previous operating cycle may be an initial cycle when the ice maker appliance is first commissioned, e.g., first installed at the point of use. Thus, the ice maker may be brand new when the temperature change rate threshold is calculated based on an actual operating cycle of the ice maker appliance, whereby the temperature change rate threshold may be an optimal or ideal temperature change rate. In some embodiments, the maximum temperature change rate threshold may be a percentage of the temperature change rate from the previous operating cycle, such as about one hundred and five percent (105%) or more, such as about one hundred and ten percent (110%), such as about one hundred twenty five percent (125%) of the measured and stored temperature change rate from the previous operating cycle. As another example, the maximum temperature change rate threshold may be based on additional stored temperature change rates from additional previous operating cycle of the ice maker appliance, such as an average temperature change rate of multiple previous operating cycles. Thus, in some embodiments, the maximum temperature change rate threshold may be tailored to the specific ice maker appliance unit and installation and operation conditions thereof.

In some embodiments, the maximum temperature change rate threshold may be a fixed predetermined value. For example, the maximum temperature change rate threshold may be a preprogrammed factory setting of the ice maker appliance. Such embodiments may advantageously reduce the likelihood of false negatives, e.g., when a leak develops very slowly over time and gradually skews the actual temperature change rate, and may provide a simpler algorithm with relatively low memory and processing requirements.

Referring now generally to FIGS. 9 through and 11, the methods 900, 1000 and/or 1100 may be interrelated and/or may have one or more steps from any one of the methods 900, 1000 and/or 1100 combined with any other method 900, 1000 and/or 1100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an ice maker appliance, the ice maker appliance comprising a mold body and a harvest motor, the method comprising:

directing liquid water to the mold body;

determining that ice has formed in the mold body after directing the liquid water to the mold body;

harvesting the ice from the mold body, wherein harvesting the ice from the mold body comprises activating the harvest motor;

measuring, during harvesting the ice from the mold body, a torque of the harvest motor;

determining that the measured torque of the harvest motor is less than a minimum harvest torque threshold, the minimum harvest torque threshold is proportional to an expected volume of ice in the mold body;

determining, based on the measured torque of the harvest motor less than the minimum harvest torque threshold, that at least a portion of the liquid water escaped; and providing a user notification in response to determining that at least the portion of the liquid water escaped.

2. The method of claim 1, wherein the ice maker appliance further comprises a flow meter, the method further comprising measuring a flow rate of the liquid water while directing the liquid water to the mold body and determining a volume of the liquid water from the measured flow rate, and wherein determining that ice has formed in the mold body is based on the determined volume of the liquid water.

3. The method of claim 1, wherein the ice maker appliance further comprises a water filter, the method further comprising determining a status of the water filter, wherein determining that ice has formed in the mold body is based on the status of the water filter.

4. The method of claim 3, further comprising determining a flow rate of the liquid water based on the status of the water filter and determining a volume of the liquid water from the determined flow rate, wherein determining that ice has formed in the mold body is based on the determined volume of the liquid water.

5. The method of claim 1, wherein the ice maker appliance further comprises a temperature sensor, the method further comprising monitoring a temperature at the mold body with the temperature sensor, wherein determining that ice has formed in the mold body is based on the monitored temperature reaching an ice formation threshold.

6. The method of claim 1, wherein the ice maker appliance further comprises a temperature sensor, the method further comprising monitoring a temperature at the mold body with the temperature sensor, wherein determining that ice has formed in the mold body is based on the monitored temperature over time.

7. The method of claim 1, wherein the mold body comprises an ice tray, wherein harvesting the ice from the mold body comprises twisting the ice tray, and wherein the measured torque of the harvest motor comprises a torque generated while twisting the ice tray.

8. The method of claim 1, further comprising calculating an ice making time after directing the liquid water to the mold body and determining that the calculated ice making time is less than an allowed ice making time, wherein determining that at least the portion of the liquid water escaped is further based on the calculated ice making time less than the allowed ice making time.

9. The method of claim 1, further comprising calculating a temperature change rate of a temperature of the mold body after directing the liquid water to the mold body and determining that the calculated temperature change rate is greater than a maximum temperature change rate threshold, wherein determining that at least the portion of the liquid water escaped is further based on the calculated temperature change rate greater than the maximum temperature change rate threshold.

* * * * *